US008901848B2

(12) United States Patent
Watanabe et al.

(10) Patent No.: US 8,901,848 B2
(45) Date of Patent: Dec. 2, 2014

(54) LIGHTING APPARATUS

(75) Inventors: Hiroaki Watanabe, Kanagawa-ken (JP); Keiichi Shimizu, Kanagawa-ken (JP); Kozo Ogawa, Kanagawa-ken (JP); Erika Takenaka, Kanagawa-ken (JP); Akimichi Takahashi, Kanagawa-ken (JP); Shinji Nogi, Tokyo (JP); Shinichi Kumashiro, Kanagawa-ken (JP)

(73) Assignees: Toshiba Lighting & Technology Corporation, Kanagawa-ken (JP); Kabushiki Kaisha Toshiba, Tokyo (JP)

( * ) Notice: Subject to any disclaimer, the term of this patent is extended or adjusted under 35 U.S.C. 154(b) by 204 days.

(21) Appl. No.: 12/570,220

(22) Filed: Sep. 30, 2009

(65) Prior Publication Data

US 2010/0079087 A1 Apr. 1, 2010

(30) Foreign Application Priority Data

Sep. 30, 2008 (JP) ..... 2008-252345

(51) Int. Cl.

| | |
|---|---|
| ***H05B 37/02*** | (2006.01) |
| ***F21V 23/04*** | (2006.01) |
| ***F21V 7/00*** | (2006.01) |
| ***F21V 13/10*** | (2006.01) |
| ***F21S 8/04*** | (2006.01) |
| ***F21V 23/00*** | (2006.01) |
| *F21Y 111/00* | (2006.01) |
| *F21Y 101/02* | (2006.01) |
| *F21Y 113/00* | (2006.01) |
| *F21Y 103/00* | (2006.01) |
| *F21Y 105/00* | (2006.01) |

(52) U.S. Cl.

CPC ..... *F21V 7/0008* (2013.01); *F21V 23/04* (2013.01); *F21V 7/005* (2013.01); *F21V 13/10* (2013.01); *F21S 8/04* (2013.01); *F21Y 2111/004* (2013.01); *F21V 23/003* (2013.01); *F21Y 2101/02* (2013.01); *F21Y 2113/00* (2013.01); *F21Y 2103/003* (2013.01); *F21Y 2105/001* (2013.01); *F21V 7/0016* (2013.01); *F21Y 2111/002* (2013.01)

USPC ..... 315/294; 362/84

(58) Field of Classification Search

USPC ..... 315/291, 294, 308, 307; 362/30, 84

See application file for complete search history.

(56) References Cited

U.S. PATENT DOCUMENTS 6,007,209 A * 12/1999 Pelka ..... 362/30
7,559,664 B1 * 7/2009 Walleman et al. ..... 362/84

(Continued)

FOREIGN PATENT DOCUMENTS

CN 101501394 8/2009
DE 29620583 6/2002

(Continued)

OTHER PUBLICATIONS

English language abstract of JP-05-081912.

(Continued)

*Primary Examiner* — Tung X Le
*Assistant Examiner* — Jonathan Cooper
(74) *Attorney, Agent, or Firm* — DLA Piper LLP (US)

(57) ABSTRACT

The present invention comprises a lighting apparatus main body having a reflecting surface, a main light source arranged in the reflecting surface of the lighting apparatus main body, a sub-light source which is arranged at the lighting apparatus main body and illuminates the neighborhood of the main light source directly, and a control circuit which controls the main light source and the sub-light source. Since the lighting apparatus illuminates downward with a direct illumination of the main light source and an indirect illumination of the sub-light source, the glare of the main light source is reduced.

19 Claims, 4 Drawing Sheets

(56) References Cited

U.S. PATENT DOCUMENTS

| | | | | |
|---|---|---|---|---|
| 2008/0259596 | A1 | 10/2008 | Biebl | |
| 2009/0153797 | A1* | 6/2009 | Allon et al. | 351/206 |
| 2009/0243455 | A1 | 10/2009 | Biebl | |

FOREIGN PATENT DOCUMENTS

| | | |
|---|---|---|
| DE | 20204352 | 7/2002 |
| DE | 102006037376 | 2/2008 |
| JP | 05-081912 | 4/1993 |
| JP | 05-334906 | 12/1993 |
| JP | 07-099008 | 4/1995 |
| JP | 2003-092006 | 3/2003 |
| JP | 2006-019160 | 1/2006 |
| JP | 2006-286433 | 10/2006 |
| JP | 2007-080533 | 3/2007 |
| JP | 2008-91238 | 4/2008 |
| JP | 2008-300203 | 12/2008 |
| WO | WO 2006/086967 | 8/2006 |
| WO | WO 2007/113751 | 10/2007 |
| WO | WO 2009/102003 | 8/2009 |

OTHER PUBLICATIONS

Machine English language translation of JP-05-081912.
English language abstract of JP-2008-091238.
Machine English language translation of JP-2008-091238.
Chinese Office Action issued in CN 200910178857.1 on Sep. 20, 2012.
English Language Translation of Chinese Office Action issued in CN 200910178857.1 on Sep. 20, 2012.
English Language Abstract of CN 101501394 publised Aug. 5, 2009.
English Language Abstract of DE 20204352 published Jul. 25, 2002.
Extended European Search Report issued in EP 09171660.5 on Jul. 20, 2012.
Japanese Office Action issued in JP 2009-215496 dated Mar. 13, 2013.
English Language Translation of Japanese Office Action issued in JP 2009-215496 dated Mar. 13, 2013.
English Language Abstract of JP 07-099008 published Apr. 11, 1995.
English Language Translation of JP 07-099008 published Apr. 11, 1995.
English Language Abstract of JP 2007-080533 published Mar. 29, 2007.
English Language Translation of JP 2007-080533 published Mar. 29, 2007.
English Language Abstract of JP 2003-092006 published Mar. 28, 2003.
English Language Translation of JP 2003-092006 published Mar. 28, 2003.
English Language Abstract of JP 2006-019160 published Jan. 19, 2006.
English Language Translation of JP 2006-019160 published Jan. 19, 2006.
English Language Abstract of JP 2006-286433 published Oct. 19, 2006.
English Language Translation of JP 2006-286433 published Oct. 19, 2006.
Japanese Office Action issued in JP 2009-215496 on May 28, 2008.
English Language Translation of Japanese Office Action issued in JP 2009-215496 on May 28, 2008.
English Language Abstract of JP 2008-300203 published Dec. 11, 2008.
English Language Translation of JP 2008-300203 published Dec. 11, 2008.
Japanese Office Action issued in JP 2009-215496 on Aug. 7, 2013 with an English languaae translation.
English Language Abstract and Translation of JP 05-334906 published on Dec. 17, 1993.

* cited by examiner

LIGHTING APPARATUS

CROSS REFERENCE TO THE RELATED APPLICATION

This application is based upon and claims the benefit of priority from prior Japanese Patent Application No. 2008-252345, filed. Sep. 30, 2008, the entire contents of which are incorporated herein by reference.

FIELD OF THE INVENTION

The present invention relates to a lighting apparatus which is capable of reducing glare.

DESCRIPTION OF THE BACKGROUND

Recently, a lighting apparatus employing LED (Light Emitting Diode) as a light source performing a main lighting has been developed for obtaining a high-power light output or a high efficiency light output.

For example, Japanese Patent Application Publication No. 2008-91238, discloses an LED light, which directly illuminates a room or an indoor with a light illuminated downward from a plurality of LEDs arranged on a main surface, and which indirectly illuminates the room with another light illuminated from a different group of LEDs mounted on a tapered surface formed backward from the main surface by reflecting the illuminated light on a reflecting surface facing the tapered surface.

On the other hand, Japanese Patent Application Publication No. 05-81912, discloses a lighting apparatus which is arranged a straight fluorescent light tube on the bilateral portions of a lighting apparatus main body, respectively. The direct illumination is carrying out by the illuminated light to a lower part from each fluorescent light tube.

And the indirect illumination is carrying out by the reflected light which is illuminated to the main surface formed in the central region of the lighting apparatus main body and upwards in the interior of a room from each fluorescent light tube.

Since the lighting apparatus disclosed in the Japanese Patent Application Publication No. 05-81912, can brighten the whole illumination opening, the lighting apparatus can reduce reflection of the light source to the display surface of an indoor personal computer etc., while it can illuminate the interior of a room brightly.

When the lighting apparatus with the structure disclosed in the Japanese Patent Application Publication No. 05-81912, in addition, adopts point light sources, such as LED, instead of a fluorescent light as a main light source for direct illumination, the interior of a room can be illuminated to some extent by the indirect light.

However, the luminance must be made fairly high in order to obtain a direct illumination light comparable as a fluorescent light by LED.

Therefore, it is difficult to reduce the glare of the main light source only with the art of Japanese Patent Application Publication No. 05-81912.

The present invention has been made in view of solving the afore-mentioned problems, and an object of the present invention is to reduce glare of a main light source in the lighting apparatus employing a point light source such as an LED as a main light source for directly illuminating a room.

SUMMARY OF THE INVENTION

The lighting apparatus according to the first aspect of the present invention is provided with a lighting apparatus main body having a reflecting surface, a main light source arranged in the reflecting surface of the lighting apparatus main body, a sub-light source which is arranged at the lighting apparatus main body and illuminates the neighborhood of the main light source directly, and a control circuit controlling the main light source and the sub-light source.

The control circuit may be individually provided so that a main light source and an sub-light source may be controlled independently, respectively, or both the light sources may controlled with single control circuit.

The lighting apparatus according to the second aspect of the present invention, is provided with: a lighting apparatus main body which has the reflecting surface which counters an illumination opening; a main light source which is arranged in the reflecting surface and illuminates light to the illumination opening; a sub-light source which illuminates the reflecting surface near the main light source directly: a shading portion which shade the sub-light source from the illumination opening; and a control circuit which controls the main light source and the sub-light source.

As for both reflecting surfaces, a curved surface, a plane surface may exist or these may coexist. And, a reflecting surface may be a region which carries out diffuse reflection of the light.

Although a sub-light source has preferred LED for a miniaturization and a weight saving, all the light sources that a fluorescence lamp, organic electroluminescence, etc. can illuminate with the reflecting surface near the main light source are permitted.

The cover which has transparency, translucent, opaque white or optical diffuseness may be provided in an illumination opening.

The lighting apparatus according to the third aspect of the present invention is characterized by the plurality of the main light sources are arranged with a predetermined interval in the reflecting surface, the light outputs of the main light source are set up to reduced gradually toward the central region of the reflecting surface and the sub-light source illuminate toward the central region of the reflecting surface near the main light source.

The lighting apparatus according to the fourth aspect of the present invention is characterized by arranging the main light source on the outer side of the lighting apparatus main body, arranging the sub-light source at the central region of the lighting apparatus main body, and illuminating the neighborhood of the main light source.

The lighting apparatus according to the fifth aspect of the present invention is characterized by a region where light of the main light source is illuminated, and a region where the reflected light is illuminated have overlapped.

A lighting apparatus according to the sixth aspect of the present invention, is characterized by a shading region boundary line of the main light source and a light line of reflected light near the main light source are almost parallel.

A lighting apparatus according to the seventh aspect of the present invention is characterized by a color temperature of the main light source is lower than a color temperature of the sub-light source.

A lighting apparatus according to the eighth aspect of the present invention is characterized by one of the sub-light sources illuminates a reflecting surface between the main light sources which are closely aligned.

A lighting apparatus according to the ninth aspect of the present invention is characterized by the arrangement pitch of the sub-light source is closer rather than an arrangement pitch of the main light source.

A lighting apparatus according to the tenth aspect of the present invention is characterized by the main light source is arranging each in a concave portion.

A lighting apparatus according to the eleventh aspect of the present invention is characterized by the control circuit controls only the main light source when a control signal is more than the predetermined degree, and the control circuit switches off the main light source and controls the sub-light source when a control signal is less than the predetermined degree.

A lighting apparatus according to the twelfth aspect of the present invention is characterized by the control circuit controls a changing rate of output the sub-light source is smaller than a changing rate of output of the main light source.

BRIEF DESCRIPTION OF DRAWINGS

The accompanying drawings, which are incorporated in and constitute a part of this specification, illustrate embodiments of the present invention and together with the description, serve to explain the principles of the present invention.

DETAILED DESCRIPTION OF THE EMBODIMENTS ACCORDING TO THE PRESENT INVENTION

Referring now to the attached drawings, FIGS. 1 to 12, some embodiments of the present invention will be explained.

Figure 1:
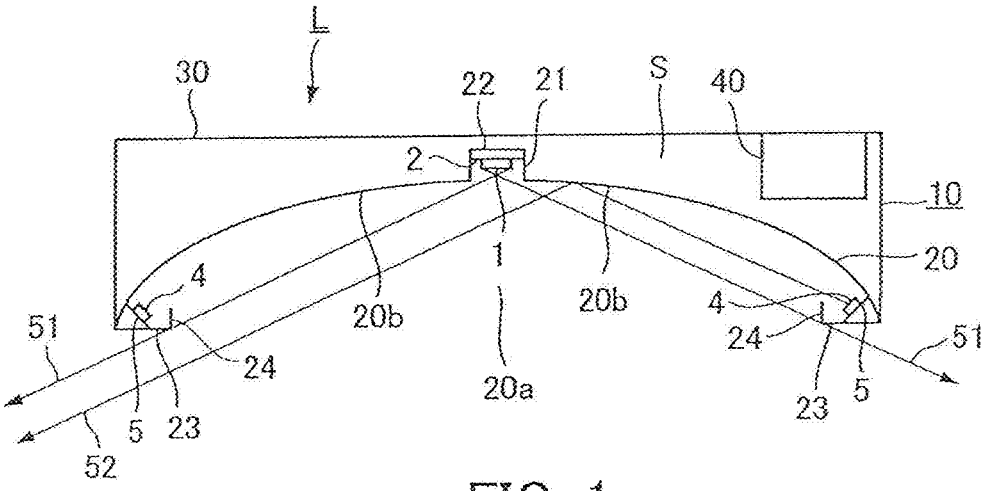
FIG. 1 is a sectional view of the lighting apparatus according to a first embodiment of the present invention.

FIG. 1 is a sectional view of the lighting apparatus according to a first embodiment of the present invention.

Figure 2:
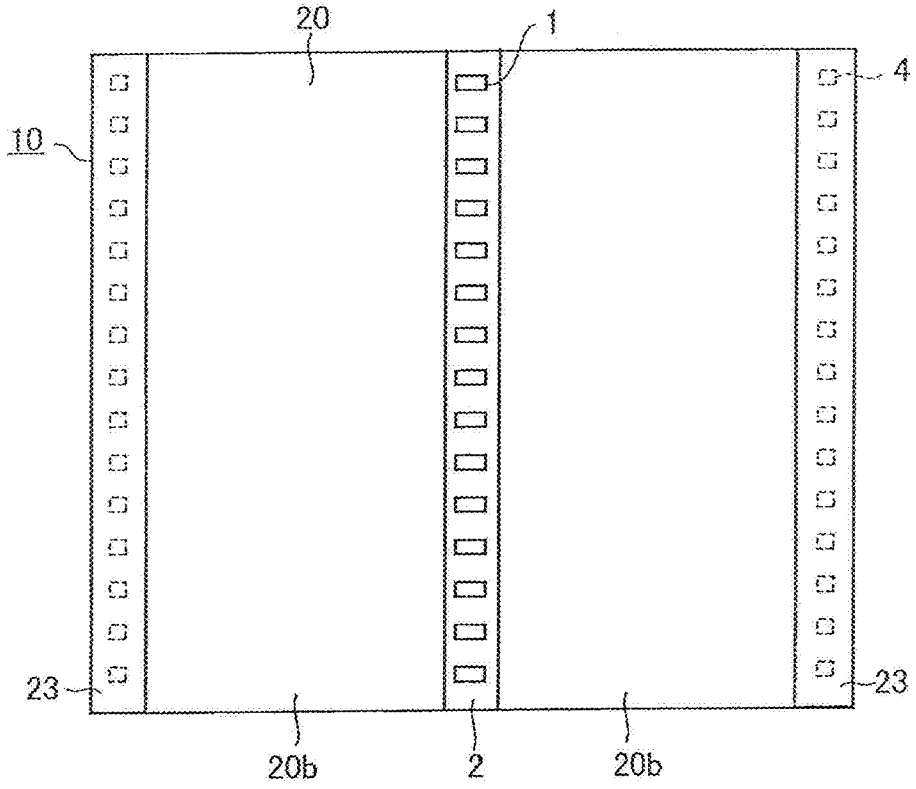
FIG. 2 is a front view of the lighting apparatus according to a first embodiment of the present invention.

FIG. 2 is a front view of the lighting apparatus according to the first embodiment of the present invention.

As shown in FIG. 1, the lighting apparatus L has a section which curves in the narrow side direction.

The lighting apparatus L is comprised of LEDs making multiple first light sources 1, sub-light source 4, a lighting apparatus main body 10, and a control unit 40.

The lighting apparatus main body 10 is defined an illumination opening 20*a* at the underside thereof.

The lighting apparatus main body 10 is comprised of a reflector plate 20 whose reflecting surface 20*b* curves upward, and a chassis 30 for holding the reflector plate 20.

As shown in FIG. 2, the plurality of main light source 1 respectively constituting point light sources, for example, LEDs, are aligned in line on a base plate 2 at predetermined intervals.

The reflecting plate 20 has concave portions 21 extending upward from the top thereof, as shown in FIG. 1, The concave portions 21 are aligned in the longitudinal direction of the lighting apparatus L itself, as shown in FIG. 2. The base plate 2 holding the main light source 1 is fixed, to the top plane portion 22 of the concave portions 21 by fixing means such as screw threads, etc.

The sub-light source 4 are comprised of multiple LED mounted on a longitudinal base plate 5. The plurality of LEDs, i.e., the sub-light source 4 are aligned in line on a mounting portions 23 provided on both longitudinal sides of the reflecting plate 20.

The light emitted from sub-light sources 4 mainly illuminate on reflecting surface 20*b* of the reflector plate 20, and is reflected to the illumination opening 20*a*.

The shading portion 24 extending toward the reflector plate 20 from the side portion of the mounting portions 23 is formed in the side portion of the sub-light sources 4 again.

Therefore, if the reflecting surface 20*b* side is seen from the illumination opening 20*a*, the sub-light sources 4 are hidden by the shading portion 24, and cannot recognize it visually.

The control unit 40 is arranged in the space S formed between the chassis 30 and the reflector plate 20.

The control circuit (not shown) which carries out lighting control of the main light source 1 and the sub-light sources 4 is provided in the control unit 40.

Now, the operation of the present embodiment will be described below.

When the lighting apparatus L is turned ON, the main light source 1 and sub-light sources 4 will be tuned off, and light will be emitted from each light source.

The light emitted from the main light source 1 primarily go downward, and illuminates the interior of a room from illumination opening 20*a* of lighting apparatus main body 10.

For this reason, when the main light source 1 are seen an illumination opening 20*a* from lower part, that luminance will be very high and person staying in the room will feel strong glare.

However, the lights emitted from the sub-light source 4 are illuminated downward through the illumination opening 20*a*, respectively. At this time, since the light emitted from sub-light source 4 directly illuminates the reflective surface 20*b* in the neighborhood of the main-lighting sources 1, the luminance difference between the main light source 1 and reflective surfaces 20*b* becomes small, and the glare of the main light sources 1 is reduced.

A part of light emitted from the main light sources 1 is reflected on the inner wall surface of concave portions 21. The inner wall surface of the concave portions 21 interrupts the direct illumination light of the main light source 1.

Then, in a region obliquely downward the illumination opening 20*a*, the glare of the illumination light is reduced compared with a region just beneath the illumination opening 20*a*.

As shown in FIG. 1, the light emitted from the main light source 1 is shaded by the lower end of the lighting apparatus main body 10, for example, a mounting portion 23. That is, arrow line 51 which connects the main light source 1 and the lower end of mounting portion 23 in FIG. 1 shows the light-shaded region boundary line for the main light source 1. The main light source 1 are not faced from an upper region rather than the light-shaded region boundary line 51. Therefore, the light of a main light source 1 illuminates to the lower region surrounded by two right and left arrow lines 51.

On the other hand, the light emitted from sub-light sources 4 are reflected in the direction of straight line 52 by reflecting surface 20*b*.

Here, straight line 52 shows the light source axis of the reflected light from sub-light sources 4.

Therefore, the region where the reflected light of sub-light sources 4 are illuminated is the circumference of straight line 52.

The lighting apparatus L according to the present embodiment reduces the luminance difference between the main light source 1 and its circumference because sub-light sources 4 illuminate the neighborhood of the main light source 1 directly, the glare of the main light source 1 is reduced.

The lighting apparatus L is constituted by that the regions where light of the main light source and the reflected light are illuminated have overlapped.

Since the light from the main light source 1 and the reflected light from sub-light sources 4 are illuminated by the overlap region, when the lighting apparatus L is looked up at from this overlap region, the luminance difference between the main light source 1 and reflective surface 20*b* of that neighborhood is reduced.

In the meantime, generally, it is rare for a person staying in the room to face a light directly from right under, and it looks up from a slanting lower part in many cases.

Therefore, in order to reduce the glare of a light, it is effective if the glare of the light source is reduced when a person staying in the room looks up at a light from a slanting lower part.

If arrow line 51 which shows the shading region boundary line of the main light source 1, and light source axis 52 of the reflected light from a sub-light source are made almost parallel there as shown in FIG. 1, the glare when seeing the lighting apparatus L from a slanting lower part is reduced.

At this time, the arrow line 51 of the main light source 1 and light source axis 52 of reflected light from sub-light sources 4 become almost parallel.

The glare of the main light source 1 is reduced, when looking up at the lighting apparatus L in this way by performing simultaneously direct illumination by the main light source 1, and indirect illumination by sub-light sources 4 from illumination opening 20*a*.

Since the whole illumination opening 20*a* can be made bright, the luminance of the lighting apparatus L can be improved.

If downward required illumination is enough to some extent with indirect illumination, the light output of the main light source 1 which performs direct illumination can be lowered relatively, and the glare of the main light source 1 can be reduced further.

In addition, the region where the light of sub-light sources 4 are illuminated may also contain base plate 2 by which not only about one main light source reflecting surface 20*b* but the main light source 1 are arranged.

If it is the composition that in addition the light from sub-light sources 4 are illuminated to the surface of base plate 2 between adjoining main light sources 1, the glare of the main light source 1 is further reduced.

Figure 3:
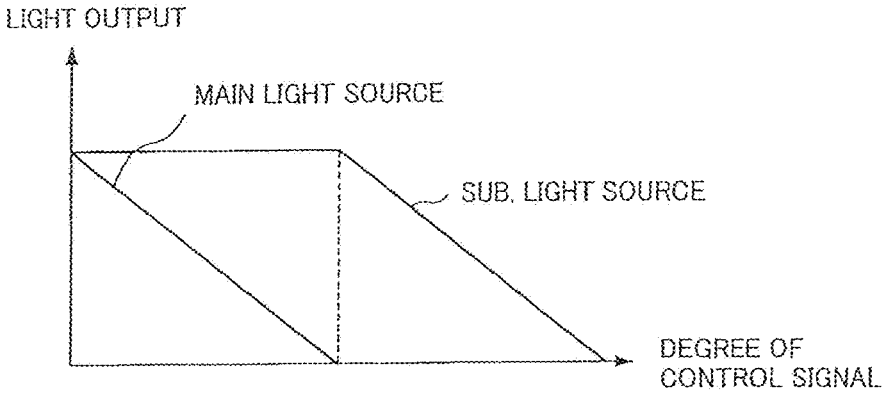
FIG. 3 shows a first control method.
Figure 4:
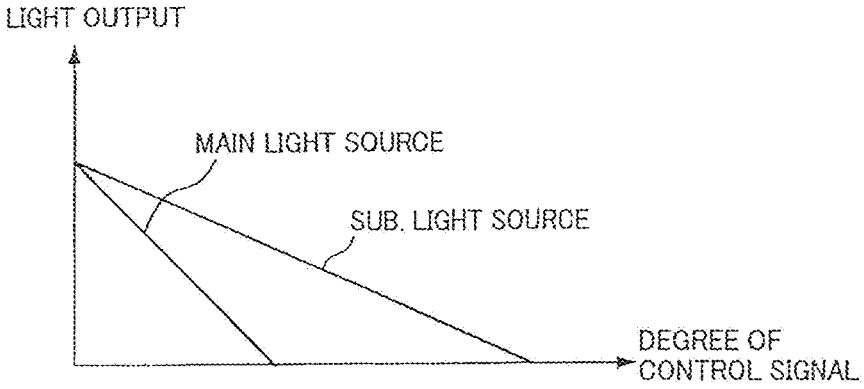
FIG. 4 shows a second control method.

Referring now to FIGS. 3 and 4, the controlled light method will be described.

When the optical power of LED which constitutes the main light source 1 and sub-light sources 4 are controlled, The luminance difference between the light of the main light source 1 and the reflected light of the circumference of it is decreased, and the glare of the main light source 1 is reduced.

As shown in FIG. 3, when the lighting apparatus is controlled according to the present invention, the degree of the control signal inputted into a control circuit is gradually lowered from 100%, First, only the light output of the main light source 1 is controlled until the optical power of the main light source 1 becomes 0%, and the sub-light sources 4 are controlled after that.

That is, let the degree of a control signal in case the optical power of the main light source 1 is 0% be a threshold, when the degree of a control signal is more than the threshold, only the main light source 1 is controlled. When the degree of a control signal is less than a threshold, the main light source 1 is switched off and the sub-light sources 4 are controlled.

If the optical power ratio of the main light source 1 at the 100% lighting and the light output of the sub-light source is set up in a proper value, it is prevented that the optical power of sub-light sources 4 to the predetermined optical power of the main light source 1 dose not becomes below an expected value.

The smaller the luminance difference of the emitted light of the main light source 1 and the light reflected at around the main light source 1 is, the more the glare of the main light source 1 is reduced. If the luminance of the reflected light on the neighborhood of main light source 1 is constant and the luminance of the main light source 1 is smaller, the glare of the main light source 1 will be reduced more.

Therefore, by preferentially controlling the main light source 1 than the sub-light sources 4, the luminance ratio of the main light source 1 and the reflected light of the circumference of it can be maintained below an expected value, and the glare of the main light source 1 is reduced.

Further, as shown in FIG. 4, the main light source 1 and sub-light sources 4 may be simultaneously controlled with a control signal.

That is, the changing rate of the light output of sub-light sources 4 are made smaller than that of the main light source 1.

The light output ratio of the main light source 1 and sub-light sources 4 become below an expected value, and the glare by the main light source 1 is reduced more.

In addition, two control circuits may be provided so that the main light source 1 and sub-light sources 4 may be controlled independently, respectively, or both the light sources may be controlled by single control circuit.

Figure 5:
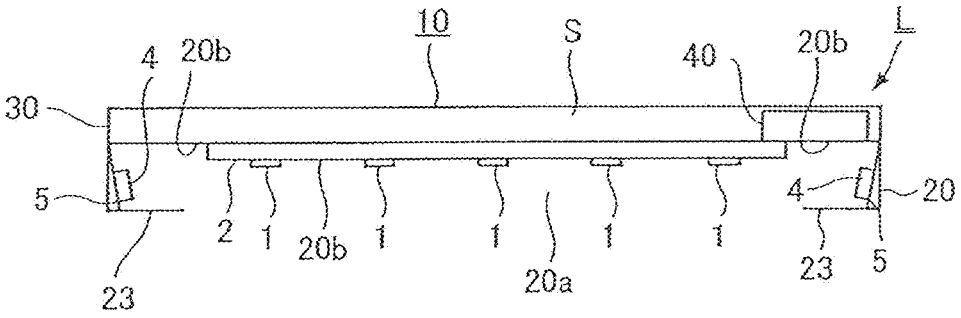
FIG. 5 is a sectional view of the lighting apparatus according to a second embodiment of the present invention.
Figure 6:
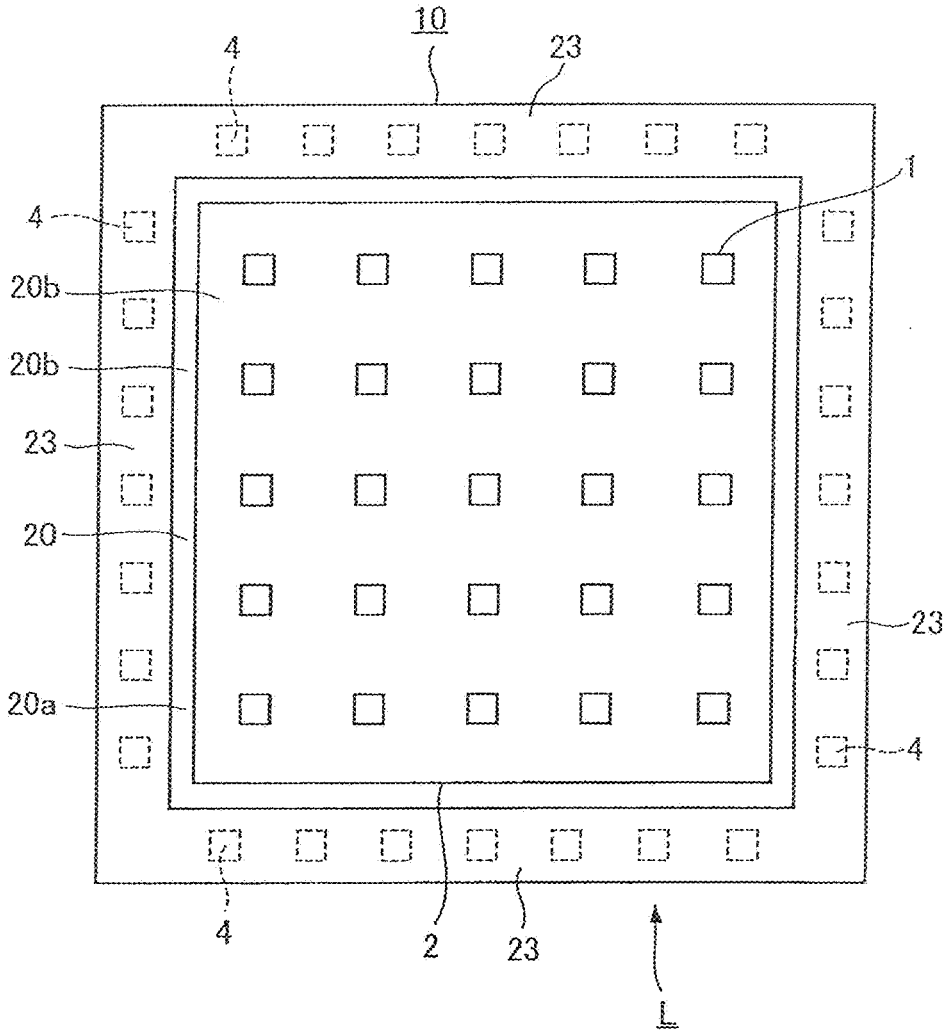
FIG. 6 is a front view of the lighting apparatus according to a second embodiment of the present invention.

Referring now to FIGS. 5 and 6, a second embodiment of the present invention will be described.

The second embodiment is assigned the same reference numerals to the same elements with the first embodiment and the explanations thereof are omitted in the following descriptions to the second embodiment.

FIG. 5 is a front view showing the lighting apparatus according to the second embodiment.

FIG. 6 is a sectional view showing the lighting apparatus according to the second embodiment.

As shown in FIG. 5 and FIG. 6, the lighting apparatus L of the second embodiment has square-shaped illumination opening 20*a* on the under-surface, base plate 2 which counters illumination opening 20*a* is formed.

The main light source 1 which forms a point light source in the undersurface of this base plate 2, respectively, for example, multiple LED, are held in the square shape matrix as a whole in the predetermined arrangement pitch.

The arrangement of main light source 1 may not be restricted to the square shape, and may be rectangular shape.

Reflecting surface 20*b* which has diffuseness is formed in the region of reflector 20 which supports base plate 2 holding main light source 1, and this base plate 2 which counters with illumination opening 20*a*, respectively.

Sub-light sources 4 are arranged at mounting portion 23 provided on the edge of lighting apparatus main body 10 so that the circumference of the matrix arrangement region of the main light source 1 are surrounded.

As shown in FIG. 6, sub-light sources 4 are formed in the position separated from the matrix arrangement region of the main light source 1. And sub-light sources 4 are arranged at the position between the adjoining main light source 1.

The light emitted from sub-light sources 4 illuminate most strongly to the reflective surface 20*b* between the adjoining main light source 1.

Reflecting surface 20*b* around each main light source 1 can be illuminated effectively.

As the reflecting surface 20*b* of reflector 20 has diffuseness, when the lighting apparatus L is seen from a lower part, base plate 2 by which the main light source 1 have been arranged, and the reflective surface 20*b* seem to be shine by reflecting light wholly.

For this reason, the luminance difference between the main light source 1 and reflecting surface 20*b* becomes small, and the glare of the main light source 1 is reduced.

As shown in FIG. 6, when multiple main light source 1 are arranged with a predetermined interval, the distance from the main light source 1 to sub-light sources 4 differ according to the position of the main light source 1.

The luminance of the reflecting surface 20*b* will fall in proportion to the distance from the main light source 1 to the sub-light sources 4.

If it sets up so that the light source axis of the light illuminated from sub-light sources 4 may be on sub-light sources 4 side rather than the central part of main part of an lighting apparatus 10, the luminance of reflective surface 20*b* of the main part of lighting apparatus 10 will fall.

If the luminance of reflective surface 20*b* by the center side of an lighting apparatus 10 falls, a luminance difference between the light of the main light source 1 and the light of the reflective surface 20*b* will become large. The glare of the central part of an lighting apparatus increases compared with the glare of the circumference as a result.

Therefore, the closer one main light source in the plurality of main light source 1 laid to the central portion of the alignment of the main light source 1 which are aligned at a predetermined intervals, the more the light output of the one main light source in the plurality of main light source 1 decreased.

On the other hand, sub-light sources 4 emit a prescribed interval toward the central part of the installation surface of the main light source 1 arranged by having from the circumference of the main light source 1, and it may be made to illuminate the neighborhood of each main light source 1.

Figure 7:
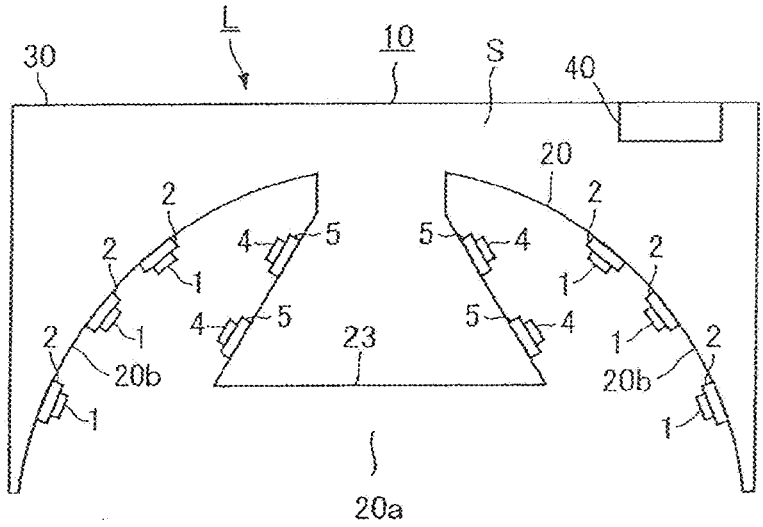
FIG. 7 is a sectional view of the lighting apparatus according to a third embodiment of the present invention.
Figure 8:
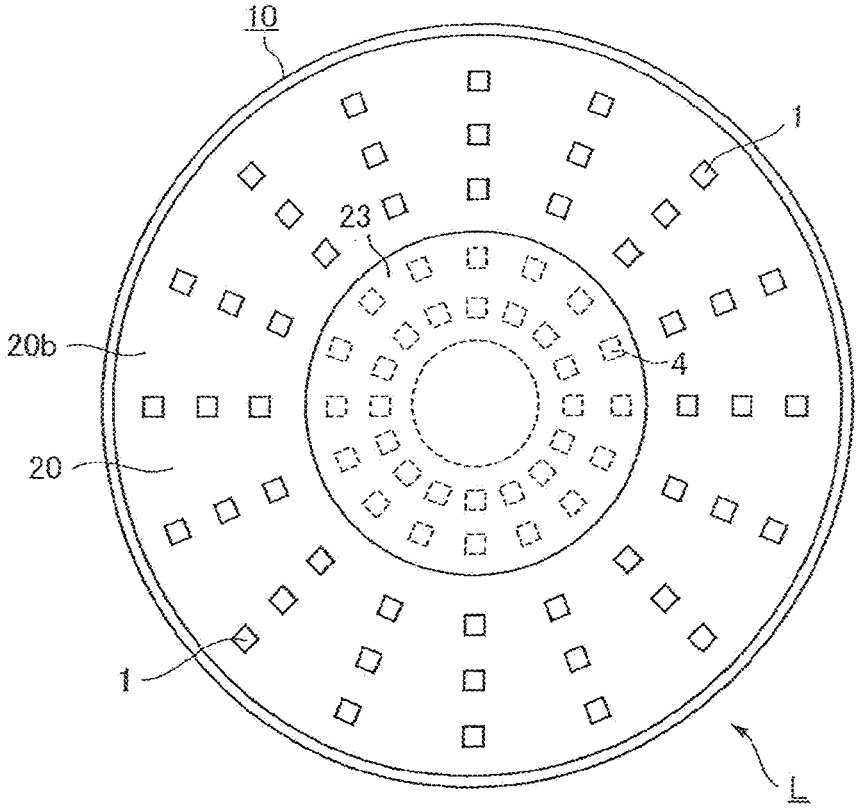
FIG. 8 is a front view of the lighting apparatus according to a third embodiment of the present invention.

Referring now to FIGS. 7 and 8, a third embodiment of the present invention will be described.

The third embodiment is assigned the same reference numerals to the same elements with the first and second embodiments and the explanations thereof are omitted in the following descriptions to the third embodiment.

FIG. 7 is a front view showing the lighting apparatus according to the third embodiment.

FIG. 8 is a sectional view showing the lighting apparatus according to the third embodiment.

As shown in FIG. 7 and FIG. 8, the lighting apparatus L according to the third embodiment has circular illumination opening 20*a*, Multiple main light source 1 which form a point light source in the position which counters illumination opening 20*a*, respectively have a predetermined interval.

It is circularly arranged on base plate 2 as a whole. Main light source 1 are not restricted to what has a predetermined interval and has been arranged circularly, and may be arranged on a base plate 2 in the shape of a matrix.

Reflecting surface 20*b* which has diffuseness is formed in counter part of illumination opening 20*a* of reflector 20. The main light source 1 are arranged on the base plate 2, and this base plate 2 are attached on the reflecting surface 20*b*

The sub-light sources 4 are arranged on the mounting portion 23 provided in the central part of lighting apparatus main body 10 and the sub-light sources 4 illuminate to the neighborhood of the main sources 1 toward the outside of the lighting apparatus main body 10 from the central part.

As shown in FIG. 8, the sub-light sources 4 are formed along with the sequence of the main light source 1. The light source axis is in agreement with the sequence of the main light source 1.

However, it is possible that the sequence of the sub-light sources 4 differ from the sequence of the main light source 1. The light emitted from sub-light sources 4 illuminate most strongly to reflecting surface 20*b* between the sequences of the main light source 1, and reflecting surface 20*b* around each main light source 1 can also be illuminated effectively.

Since the reflecting surface 20*b* has diffuseness when the lighting apparatus L is seen from a lower part, the base plate 2 arranged in the main light source 1 and the reflective surface 20*b* seem to be shine by reflecting light wholly.

For this reason, the luminance difference between the main light source 1 and reflecting surface 20*b* becomes small, and the glare of the main light source 1 is reduced.

It is possible to apply to the second and third embodiments the composition of the first embodiment that the lighting apparatus L is constituted by that a region where light of the main light source is illuminated and a region where the reflected light is illuminated have overlapped.

In the second embodiment, the arrow line which shows the shading region boundary line of the main light source and light source axis of the reflected light from a sub-light source may be made substantially parallel.

As shown in FIGS. 3 and 4, the controlled light method is described in the first embodiment. This controlled light method decreases the luminance difference between the main light source and the reflecting surface of the circumference, and the glare of the main light source 1 is reduced.

This controlled light method is possible to adapt to the second and third embodiments.

The following modification is applicable also in the first, second, and third embodiments.

A modification making each main light source 1 arranged in concave portion 21 illuminates light on the inner wall surface of concave portion 21, and the inner wall surface reflect a part of light. The luminance difference between the main light source 1 and the reflective surface of the circumference is decreased and the glare is especially reduced when it looks up from a slanting lower part.

A modification making the color temperature of main light source 1 be lower than the color temperature of sub-light sources 4, and making luminance of a luminescence region more uniform.

The luminance difference between the main light source 1 and the reflective surface of the circumference is decreased, and the glare of the main light source 1 is reduced.

A modification making the each sub-light sources 4 illuminate the reflective surface between the adjacent main light source 1 respectively, thereby luminance irregularity is reduced.

A modification making the arrangement pitch of sub-light sources 4 closer than the arrangement pitch of the main light source 1, thereby luminance irregularity is reduced.

Two control circuits may be provided so that the main light source and the sub-light source may be controlled independently, respectively, and the both lighting sources may be controlled in single control circuit.

The reflecting surface may be either of flat surface, curved surface or partly flat and curved surfaces.

Furthermore the reflecting surface may be a surface capable of executing diffusible reflection of light.

Although sub-light sources 4 have preferred LED for small size and a weight saving light sources, a fluorescence lamp and organic electroluminescence may be employed for it. And all the light sources which can illuminate the reflecting surface near the main light source are possible for it.

The illumination opening may be provided with a transparent, translucent, or opaque cover, or otherwise with a light-diffusible cover.

According to the first aspect of the present invention, the neighborhood of the main light source is illuminated by the sub-light source, and in order that the luminance difference between the main light source and the reflecting surface of the circumference may decrease, the glare of a main light source is reduced.

According to the second aspect of the present invention, as the glare of the main light source is reduced and indirect illumination to a lower part of the lighting apparatus can be performed by a sub-light source the luminescence region of the whole lighting apparatus is expanded, and the luminance feeling of the whole lighting apparatus improves.

According to the third aspect of the present invention, the plurality of the main light source are arranged with a predetermined interval in the reflecting surface; the light outputs of the main light source are set up to reduced gradually toward the central region of the reflecting surface; and the sub-light source illuminate toward the central region of the reflecting surface near the main light source.

The ratio of the luminance of the main light source and the luminance of the reflecting surface near the main light source can equalize independent on the place, and the glare of the central part of multiple main light sources arranged by a prescribed interval is reduced.

According to the fourth aspect of the present invention, the main light source is arranged on the outer side of the lighting apparatus main body, and the sub-light source is arranged at the center part of the lighting apparatus main body and illuminates the neighborhood of the main light source.

Since the light of the sub-light source illuminate near the main light source and the luminance difference between the main light source and the reflecting surface of the circumference is decreased, the glare of a main light source is reduced. Since the sub-light source illuminate to a lower part of the lighting apparatus indirectly, the luminance region of the lighting apparatus is expanded, and the luminance of the lighting apparatus is improved.

According to the fifth aspect of the present invention, since the region where the light of the main light source is illuminated, and the region where the light of the reflected light which the glare of the light emitted from the sub-light source reflected near the main light source is illuminated have overlapped, the glare is reduced when seeing from the region where the light of the main light source is illuminated.

According to the sixth aspect of the present invention, since the shading region boundary line of the main light source and the light source axis of the reflected light which the light emitted from the sub-light source reflected near the main light source are almost parallel, the glare is reduced when seeing especially from a slanting lower region.

According to the seventh aspect of the present invention, since the color temperature of the main light source is lower than the color temperature of a sub-light source, the luminance of a light-illuminating part becomes more uniform and can reduce glare.

The luminance difference between the main light source and the reflecting surface of the circumference decreases, and the glare of a main light source is reduced.

According to the eighth aspect of the present invention, since one of the sub-light sources illuminates the two neighborhood of the main light source at least, the luminance irregularity in the neighborhood where the light of a sub-light source is illuminated is reduced.

According to the ninth aspect of the present invention, since the arrangement pitch of the sub-light source is closer rather than the arrangement pitch of the main light source, the luminance irregularity in the neighborhood where the light of a sub-light source is illuminate is reduced.

According to the tenth aspect of the present invention, since the main light source is arranged in the concave portion and the shading region boundary line of the main light source is able to set up independent on the shape of the lighting apparatus, a luminance difference with the reflecting surface around the main light source decreases and the glare of the main light source is reduced.

According to the eleventh aspect of the present invention, the control circuit controls only the main light source when a control signal is more than the predetermined degree and the control circuit switches off the main light source and controls the sub-light source when a control signal is less than the predetermined degree.

Since the light output ratio of the sub-light source to the main light source is fixed the ratio more than the predetermined ratio, the luminance difference between the main light source and the reflecting surface of the circumference decreases and the glare of a main light source is reduced.

According to the twelfth aspect of the present invention, the main light source and sub-light source may be simultaneously controlled with a control signal and the changing rate of the light output of sub-light source is made smaller than that of the main light source. The light output ratio of the main light source and sub-light source becomes below an expected value, and the glare by the main light source is reduced more.

What is claimed is:

1. A lighting apparatus, comprising:

a lighting apparatus main body comprising a reflecting surface, the reflecting surface comprising a curved portion and a concave portion, the concave portion extending from the curved portion in a direction opposite to a light emitting direction of the lighting apparatus;

a main light source comprising a plurality of main point light sources, the plurality of main point light sources comprising a plurality of LEDs spaced apart from each other, each of the LEDs comprising an emitting surface facing directly in the light emitting direction of the lighting apparatus, the plurality of main point light sources being arranged in the concave portion of the reflecting surface of the lighting apparatus main body such that the emitting surfaces of the LEDs of the main light source are disposed relative to the entire curved portion in the direction opposite to the light emitting direction of the lighting apparatus;

a sub-light source comprising an LED arranged at the lighting apparatus main body apart from a portion of the reflecting surface in which the main light source is arranged; and a control circuit constructed and arranged to control the main light source and the sub-light source; wherein:

the curved portion of the reflecting surface curves inward from the sub-light source to the concave portion;

a light source axis of the LED of the sub-light source intersects the reflecting surface between the main light source and the sub-light source adjacent to at least one of the LEDs of the main light source; and the LED of the sub-light source is constructed and arranged to illuminate the reflecting surface adjacent to the main light source directly.

2. A lighting apparatus, comprising:

a lighting apparatus main body comprising a reflecting surface which counters an illumination opening, the reflecting surface comprising a curved portion and a concave portion, the concave portion extending from the curved portion in a direction opposite to a light emitting direction of the lighting apparatus;

a main light source comprising a plurality of main point light sources constructed and arranged to illuminate light to the illumination opening, the plurality of main point light sources comprising a plurality of LEDs spaced apart from each other, each of the LEDs comprising an emitting surface facing directly in the light emitting direction of the lighting apparatus, the plurality of main point light sources being arranged in the concave portion of the reflecting surface of the lighting apparatus main body such that the emitting surfaces of the LEDs of the main light source are disposed relative to the entire curved portion in the direction opposite to the light emitting direction of the lighting apparatus;

a sub-light source comprising a plurality of LEDs sources disposed apart from a portion of the reflecting surface in which the main light source is arranged; and a control circuit constructed and arranged to control the main light source and the sub-light source; wherein:

the curved portion of the reflecting surface curves inward from the sub-light source to the concave portion;

a light source axis of the LED of the sub-light source intersects the reflecting surface between the main light source and the sub-light source adjacent to at least one of the LEDs of the main light source; and the LED of the sub-light source is constructed and arranged to illuminate the reflecting surface adjacent to the main light source directly.

3. A lighting apparatus according to claim 1, wherein the plurality of main point light sources are arranged at predetermined intervals in the reflecting surface;

the plurality of main point light sources are arranged such that light outputs of the main point light sources reduce gradually toward a central region of the reflecting surface; and the sub-light source is constructed and arranged to illuminate toward the central region of the reflecting surface near the main light source.

4. A lighting apparatus according to claim 1, wherein the main light source is arranged on an outer side of the lighting apparatus main body, and the sub-light source is arranged at a central region of the lighting apparatus main body and is constructed and arranged to illuminate the neighborhood of the main light source.

5. The lighting apparatus according to claim 1, wherein a range where light of the main light source is illuminated and a range where the reflected light is illuminated overlap one another.

6. The lighting apparatus according to claim 1, wherein a shading range boundary line of the main light source and a light source axis of reflected light near the main light source are substantially parallel to one another.

7. The lighting apparatus according to claim 1, wherein a color temperature of the main light source is lower than a color temperature of the sub-light source.

8. The lighting apparatus according to claim 1, wherein at least one of the plurality of sub point light sources is constructed and arranged to illuminate a reflecting surface between at least some of the plurality of main point light sources which are closely aligned.

9. The lighting apparatus according to claim 1, wherein a distance between adjacent sub point light sources is less than a distance between adjacent main point light sources.

10. The lighting apparatus according to claim 1, wherein the control circuit is constructed and arranged to control only the main light source when a degree associated with a control signal is more than a threshold degree and the control circuit is constructed and arranged to switch off the main light source and control the sub-light source when the degree associated with the control signal is less than the threshold degree.

11. The lighting apparatus according to claim 1, wherein the control circuit is constructed and arranged to control a rate of change of an output of the sub-light source to be smaller than a rate of change of an output of the main light source.

12. A lighting apparatus, comprising:

a light apparatus main body comprising a reflecting surface, the reflecting surface comprising a curved portion and a concave portion, the concave portion extending from the curved portion in a direction opposite to a light emitting direction of the lighting apparatus;

a main light source comprising a plurality of main point light sources, the plurality of main point light sources comprising a plurality of LEDs spaced apart from each other, each of the LEDs comprising an emitting surface facing directly in the light emitting direction of the lighting apparatus, the plurality of main point light sources being arranged in the concave portion of the reflecting surface of the lighting apparatus main body such that the emitting surfaces of the LEDs of the main light source are disposed relative to the entire curved portion in the direction opposite to the light emitting direction of the lighting apparatus;

a sub-light source comprising a plurality of LEDs arranged at the lighting apparatus main body apart from a portion of the reflecting surface in which the main light source is arranged; and a control circuit construed and arranged to control the main light source and the sub-light source; wherein:

the curved portion of the reflecting surface curves inward from the sub-light source to the concave portion;

a light source axis of the LED of the sub-light source intersects the reflecting surface between the main light source and the sub-light source adjacent to at least one of the LEDs of the main light source; and the LED of the sub-light source is constructed and arranged to illuminate the reflecting surface adjacent to the main light source directly.

13. The lighting apparatus according to claim 1, wherein the reflecting surface in which the plurality of main point light sources is arranged is diffusive.

14. The lighting apparatus according to claim 2, wherein the reflecting surface in which the plurality of main point light sources is arranged is diffusive.

15. The lighting apparatus according to claim 12, wherein the reflecting surface in which the plurality of main point light sources is arranged is diffusive.

16. The lighting apparatus according to claim 1, wherein the light source axis of the sub-light source is directed between adjacent LEDs of the main light source.

17. The lighting apparatus according to claim 1, wherein a plane parallel to a surface on which each of the plurality of main point light sources sits intersects at an oblique angle a plane parallel to a surface on which the sub light source sits.

18. The lighting apparatus according to claim 1, wherein the sub light source comprises a plurality of LEDs, the lighting apparatus further comprising a mounting portion constructed and arranged to mount the sub light source so that the light source axes of each of the LEDs of the sub light source do not intersect the light source axes of the other LEDs of the sub light source.

19. The lighting apparatus according to claim 1, wherein the lighting apparatus is constructed and arranged to illuminate downward.

* * * * *